United States Patent [19]

Stahlecker et al.

[11] Patent Number: 4,769,983

[45] Date of Patent: Sep. 13, 1988

[54] ROLLER FOR AN OPEN-END FRICTION SPINNING ARRANGEMENT

[76] Inventors: Fritz Stahlecker, Josef-Neidhart-Strasse 18, 7347 Bad Überkingen; Hans Stahlecker, Haldenstrasse 20, 7334 Süssen, both of Fed. Rep. of Germany

[21] Appl. No.: 86,791

[22] Filed: Aug. 19, 1987

[30] Foreign Application Priority Data

Aug. 29, 1986 [DE] Fed. Rep. of Germany ..... 3629378

[51] Int. Cl.[4] ..... D01H 1/12

[52] U.S. Cl. ..... 57/401

[58] Field of Search ..... 57/400, 401, 408, 411, 57/413

[56] References Cited

U.S. PATENT DOCUMENTS

| | | | |
|---|---|---|---|
| 4,107,909 | 8/1978 | Fehrer et al. | 57/401 X |
| 4,241,571 | 12/1980 | Turk et al. | 57/401 |
| 4,327,545 | 5/1982 | Fehrer | 57/401 X |
| 4,334,400 | 6/1982 | Fehrer | 57/401 X |
| 4,399,650 | 8/1983 | Parker et al. | 57/401 |
| 4,522,022 | 6/1985 | Parker et al. | 57/401 |
| 4,696,155 | 9/1987 | Stalder et al. | 57/411 X |
| 4,698,960 | 10/1987 | Nerli et al. | 57/401 |

FOREIGN PATENT DOCUMENTS

| | | | |
|---|---|---|---|
| 3114093 | 1/1982 | Fed. Rep. of Germany . | |
| 2074201 | 10/1981 | United Kingdom | 57/401 |
| 2145746 | 4/1985 | United Kingdom | 57/401 |

*Primary Examiner*—Donald Watkins

*Attorney, Agent, or Firm*—Barnes & Thornburg

[57] ABSTRACT

A friction surface construction for open-end friction spinning of the type having a movable friction spinning member with yarn forming surface portions that imparts friction to fibers and to forming yarn is provided. The yarn forming surface portions include first surface areas surrounding air passage openings in the friction spinning member. Second surface areas are provided in between the first surface areas. At least a portion of the first surface areas include a section having a coefficient of friction value different than a coefficient of friction value of the second surface areas. A process for forming the friction surface construction is also provided.

20 Claims, 4 Drawing Sheets

41
12
42
44
45
x
y 46
47
48
49
22
50
51
52
1,2
13
12

ROLLER FOR AN OPEN-END FRICTION SPINNING ARRANGEMENT

BACKGROUND AND SUMMARY OF THE INVENTION

The invention relates to a friction surface member for an open-end friction spinning arrangement, having yarn forming surface portions that are provided with air passage openings, and to a process for manufacturing this type of friction surface member.

It is shown in German Unexamined Patent Application DE-OS No. 31 14 093 to provide the surface of a roller for a friction spinning arrangement with a coating. The coating has the purpose of making possible an advantageous friction value or coefficient of friction with respect to the fibers. It consists of a ceramic material, preferably chromium dioxide, which is applied by means of a plasma coating process. The coating in this case also takes place in the area of the outside mouths of the air passage openings, so that these receive a rounded edge.

In the case of rollers for open-end friction spinning arrangements, the air passage openings are used to cause fiber transport by means of a pneumatic flow, and to hold the fibers in the area of the yarn forming zone. However, sometimes these air passage openings interfere with the actual sequence of the spinning process. For reasons concerning manufacturing technology and also to provide sufficiently high air throughput, it is not possible to make the air passage openings very small. Therefore, during the feeding as well as during the spinning, fibers are frequently pulled into the air passage openings by the ends or by other areas. These fibers are held in these openings increasingly so that, as a result, the perfect tying-up of the fibers into the forming yarn is impaired. With a surface treatment, it was found that this effect is further increased when an increased friction effect is generated. Therefore, as a result, the effect that is produced by the increase of the friction effect which is advantageous for the spinning per se, is further impaired.

An object of the invention is to provide a friction surface member having a yarn forming surface that produces an improved tying-up of the fibers into the forming yarn.

This object is achieved by providing at least a portion of areas surrounding air passage openings with a section having a surface that has a different coefficient of friction value than the remaining area of the yarn forming surface. In certain preferred embodiments, the portion of areas surrounding the air passage openings have a section with a lower coefficient of friction value than the remaining areas of the yarn forming surface.

This development makes it possible that, on the one hand, the friction value can be selected and increased in such a way that the yarn to be spun receives an advantageous twist. On the other hand, however, the danger of fibers being pulled into the air passage openings and held fast is reduced a comparable degree such that when the present invention is used, the fibers are pulled out of the air passage openings relatively easily, without impairing the spinning process. Therefore, there is no increased resistance to the pulling-out of the fibers from the edges of the mouth.

According to advantageous features of certain preferred embodiments of the invention, it is provided that the outer mouth areas of the air passage openings have surfaces that are made of the same material as the remaining areas of the outer shell surface, but are subjected to a different surface treatment. As a result, it becomes possible in a relatively easy way to obtain the endeavored distribution of the friction values. In a further development of the invention, it is advantageous to structure the yarn forming surface outside the outer mouth areas by a surface treatment. In certain preferred embodiments, the structuring may take place, for example, by means of electrical discharge machining or laser radiation which results in miniature crater-type depressions in the surface.

According to advantageous features of certain preferred embodiments of the invention, it is provided that the outer shell surface and the outer mouth areas of the air passage openings are coated with a hard material that forms a smooth surface, and that the outer shell surface, outside the outer mouth areas, is provided with a subsequently worked-in surface structure. A hard coating of this type helps prevent early wear of the rollers. Further, during the structuring of the surface, particularly by means of electrical discharge machining or laser radiation, miniature crater-type depressions are formed in the hard coating which have edge areas without a warped (bell-mouthed) shape.

According to advantageous features of certain preferred embodiments of the invention, it is provided that the outer mouth edges of the air passage openings are rounded off before a coating is applied. This ensures that after the coating, the mouth edges maintain a defined shape that is not accidental. This defined shape is also advantageous for pulling-off of fibers projecting into the air passage openings.

According to advantageous features of certain preferred embodiments of the invention, it is provided that the shell surface of the roller in a yarn withdrawal direction is divided into two or several sections having a different coefficient of friction values. As a result, it becomes possible to take spinning conditions into account. Particularly in the area of the forming yarn tip, a smaller twist is introduced than in the area that follows where the yarn has a larger diameter.

According to certain advantageous features of certain preferred embodiments of the invention, a process is provided for forming the unique friction surface member.

According to advantageous features of certain preferred embodiments of the invention, the process provided includes:

(a) forming air passage openings into a shell of a roller;
(b) grinding an outer shell surface of the shell to a cylindrical shape;
(c) rounding off the outer mouth areas of the air passage openings;
(d) coating the outer shell surface, and outer mouth areas with a material;
(e) placing radial bearings in the roller;
(f) grinding the coating on the roller to a cylindrical shape while said roller is being held by said radial bearings;
(g) providing a rougher surface only to said outer shell surface.

By means of this process, a roller can be obtained that has an advantageous distribution of coefficient of friction values, has very precisely treated surfaces, and particularly has very good concentricity because the final cylindrical grinding takes place when the roller is already held in its operational radial bearings.

Other objects, advantages and novel features of the present invention will become apparent from the following detailed description of the invention when considered in conjunction with the accompanying drawings.

DETAILED DESCRIPTION OF THE DRAWINGS

Figure 1:
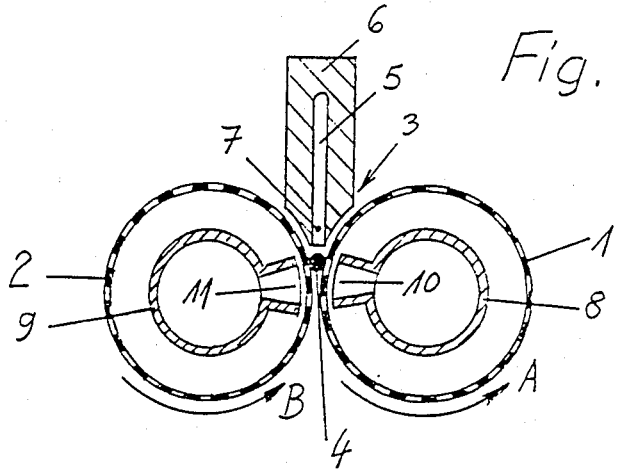
FIG. 1 is a cross-sectional view of a part of an open-end friction spinning arrangement in the area of the yarn forming region that is formed by two rollers.

The open-end friction spinning arrangement that is partially shown in FIG. 1 contains two rollers 1, 2. The rollers 1, 2, that have a cylindrical shell, are arranged in parallel next to one another, at a narrow distance from one another. Together, they form a wedge-shaped gap 3 serving as the yarn forming zone in which fibers are twisted into a yarn 4 that is withdrawn continuously in longitudinal direction of the two rollers 1, 2, i.e., essentially perpendicularly to the plane of the drawing.

The fibers that are to be spun into a yarn 4, as individual fibers, are fed via a fiber feeding duct 5 of a duct housing 6. The mouth 7 of the fiber feeding duct 5 is developed in a slot shape and extends essentially in longitudinal direction with respect to the wedge-shaped gap 3. The mouth 7 of the fiber feeding duct 5 is located at a narrow distance opposite the wedge-shaped gap 3. In a way that is not shown in detail, the fiber feeding duct 5 is connected to a known feeding and opening device by which the fibers are opened up into individual fibers from a fed sliver. The fibers are fed to the wedge-shaped gap 3 in an air flow in the fiber feeding duct 5.

The fed individual fibers and the spun yarn 4 are held in the wedge-shaped gap 3 by means of an air current that flows through the shells of the rollers 1, 2. On the inside of the rollers 1, 2, a pipe 8, 9 is arranged that in each case is connected to a vacuum source and is equipped with a suction slot 10, 11 that, on the inside of the shells of the rollers 1, 2, is directed to the area of the wedge-shaped gap 3. The shells of the rollers 1, 2, in the manner of a perforation, are provided with air passage openings 12 so that an air current is taken in via the suction slots 10, 11. The air current at least supports the transport of the fibers in the fiber feeding duct 5 and holds the fed individual fibers and the forming yarn 4 in the area of the wedge-shaped gap 3 serving as the yarn forming zone. The air passage openings 12, which in certain embodiments, are drilled, have a diameter of about 0.5 mm to 1.0 mm. Their number is selected in such a way that the ratio of the perforated area to the total area is between 30% and 50%.

The shells of the rollers 1, 2 that are disposed directly on the pipes 8, 9 by bearings that are not shown, are driven in the same rotational direction in the direction of the arrows A, B, for example, by a tangential belt that moves along simultaneously against both rollers 1, 2. Roller 1 therefore rotates into the wedge-shaped gap 3 serving as the yarn forming zone. Roller 2 rotates out of the wedge-shaped gap 3 serving as the yarn forming zone. The rollers 1, 2 therefore affect the fed individual fibers and the forming yarn 4 in the same direction as a friction force, whereby the yarn 4 receives a twist.

Figure 2:
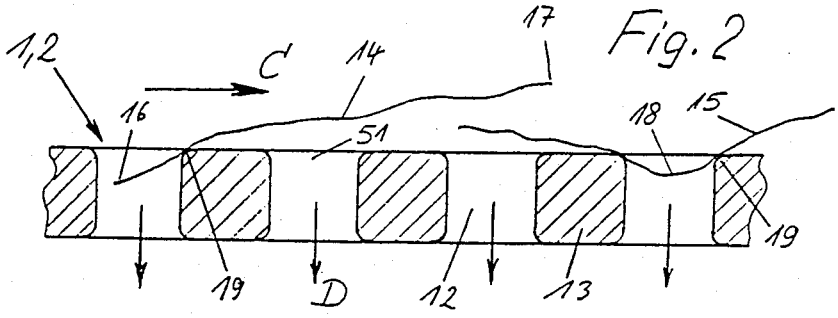
FIG. 2 is an enlarged partial longitudinal sectional view of a shell of a roller.

FIG. 2 which represents an enlarged partial sectional view along a generating line of a roller 1, 2, shows how fibers, using the example of two individual fibers 14, 15, may be affected by the air passage openings 12. This effect is explained using the fibers 14, 15 that arrive by flying through the fiber feeding duct 5. In this case, it should be observed that similar conditions also exist when the shell surfaces of the rollers 1, 2 move past the fibers that are being tied into the yarn. It is largely arbitrary, how the fibers that impinge on the shell surface at a relatively high speed actually impact on the shell surface, i.e., whether a fiber impacts with an end 16 or 17, as shown by fiber 14 or a fiber first impacts with a central area, as shown by fiber 15. If the fiber 14 impinges on the area of an air passage opening 12 with one end 16, as shown in FIG. 2, the end 16 is partially sucked into the air passage opening 12 because of the air current flowing in the direction of the arrow D through the air passage opening 12. If a fiber, such as fiber 15, impacts on an air passage opening 12 with its central area, the central area of the fiber 15, in the form of a loose loop 18, is sucked into the air passage opening 12. In both cases, the fibers 14, 15 are wound lightly around the edges 19 of the mouth 51 of the air passage openings 12 so that during the tying into the yarn 4 and during the withdrawal of the forming yarn 4, they must be withdrawn in the direction of the arrow C over these mouth edges 19. During the rotating movement of the rollers 1, 2, the fibers 14, 15 must similarly be pulled out of the air passage openings 12 which has an effect transverse to the withdrawal direction. As a result, in a way that is advantageous per se, the friction value and thus the twist given to the yarn 4 are influenced advantageously, but this influence depends on the arbitrary position of the fibers 14, 15 and is not uniform.

Using the present invention, the fibers need not overcome increased frictional resistance in the area of the air passage openings 12, and particularly in the area of the mouths 51 of these air passage openings 12, in circumferential direction, as well as in yarn withdrawal direction during the spinning, as compared to the area of the shell surface that is formed by webs 13 located between the air passage openings 12. It is therefore provided that in the area of the edges 19 of the mouths 51 of the air passage openings 12, a lower friction value or coefficient of friction exists than in the surfaces located in-between, so that on the whole, a friction effect is exercised on the fibers that is as uniform as possible. The overall effect is that the withdrawal and tying-in of individual fibers is clearly not made more difficult, in comparison to certain known rollers in which the uniformity of the yarn structure is impaired.

Figure 3:
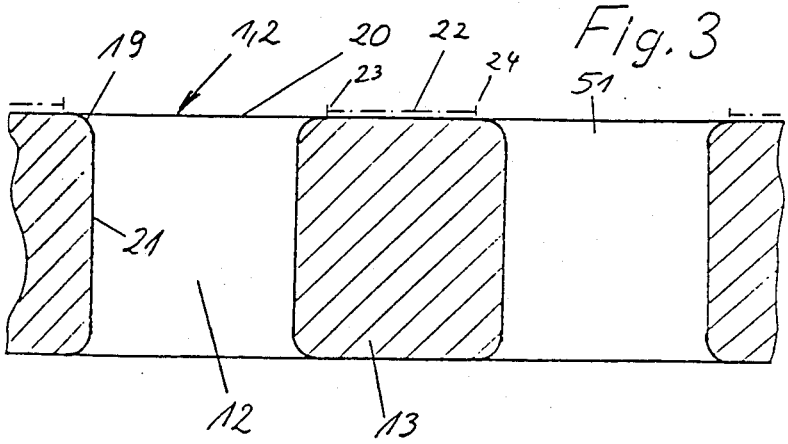
FIG. 3 is an enlarged representation of a cut-out of FIG. 2.
Figure 4:
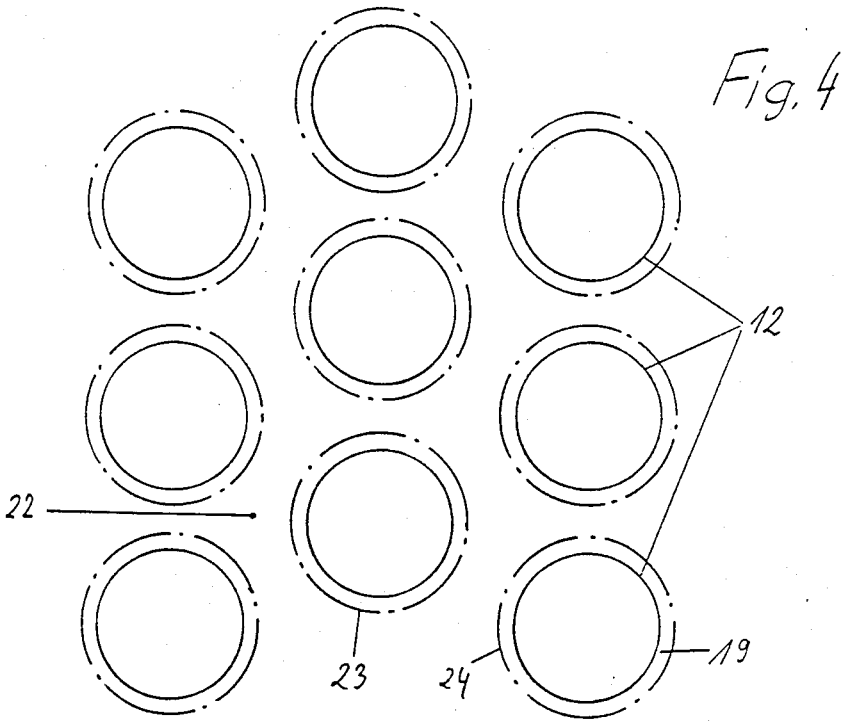
FIGS. 4 to 9 are views of surfaces of embodiments of rollers with different surface treatments.

In the embodiment according to FIGS. 3 and 4, ring-shaped areas 23, 24 are provided around the rounded-off mouth edges 19 of the outer openings 51 of the air passage openings 12 of the shells of the rollers 1, 2. The ring-shaped areas 23, 24 have a lower friction value than the area 22 located in-between the ring-shaped areas. As shown in FIG. 3, the ring-shaped areas 23, 24, as well as the area 22 in-between the shell surfaces, are made of the same basic material. However, ring-shaped areas 23, 24 and area 22 are subjected to a different surface treatment.

In certain preferred embodiments, this may, for example, take place by first surface-treating all areas 23, 24 and 22 in the same way, in order to obtain a surface that has as little friction as possible. Subsequently, area 22 is provided with a structure that causes an increased friction value. In certain preferred embodiments, this may, for example, take place by applying a coating in all areas 22 and 23, 24 that subsequently is roughened at the desired points.

It is contemplated to, in a reversed order, first roughen all areas 22 and 23, 24 by a surface treatment and subsequently smoothen areas 23, 24. In this case, the term "smooth" does not necessarily mean that a surface is obtained that is as even as possible, but only refers to a surface that has a coefficient of friction with respect to fibers which is less than the coefficient of friction in area 22.

In certain preferred embodiments, so-called orange-skin surfaces may be used, for example, those obtained by a plasma coating made of titanium dioxide or chromium dioxide. This plasma coating can then subsequently be roughened or structured by means of a minor erosion. In particular, it is contemplated to obtain this type of roughening by means of laser radiation, for example, which generates erosion craters of a miniature size. In this case, it is advantageous for the basic surface to be relatively hard so that the erosion craters do not become bell-mouthed (warped) at their edges. By using an electronic control, this type of laser radiation can be carried out very precisely according to indicated patterns so that the desired areas 22 and 23, 24 can be provided with proper corresponding friction values.

In this connection, it should be pointed out explicitly that it is contemplated that the areas 23, 24 surrounding the mouths 51 be subjected to a surface treatment causing a structure. It is also contemplated to carry out the same type of surface treatments in the areas 22 and 23, 24, such as laser radiations that cause a roughening. In such a case, however, an adaptation of the extent of the roughening or structuring in areas 22 and 23, 24 is carried out such that the desired friction value conditions are obtained.

It is also contemplated to obtain the desired adaptation of the friction values using other methods, for example, by producing coatings of a different material to the areas that are to have different friction values. It is also contemplated to provide the whole shell surface of the rollers 1, 2 with a coating that projects to the inside in the area of the mouths 51 of the air passage openings 12 and that is later smoothed or machined in this area. It is also contemplated to construct a roller 1, 2 with the desired friction value adaptation without any coating of a basic material. For example, rollers 1, 2 may consist of a steel shell having an entire surface which is well polished, including in the area of the rounded-off mouth edges 19 of the mouths 51 of the air passage openings 12. Subsequently, the areas that are to have an increased friction effect are subjected to a surface treatment, for example, to electrical discharge machining.

Figure 5:
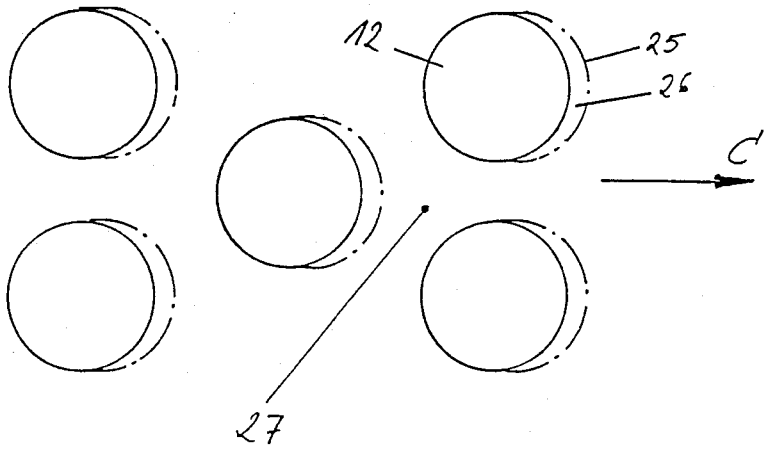

The areas with the lower friction values in the area of the mouth edges 19 of the mouths 51 of the air passage openings 12 produced in one of the ways discussed above may have a shape that deviates from the ring-shaped form In certain preferred embodiments as shown in FIG. 5, the area 26 with a lower friction value that is delimited by a part of an oval line 25 is provided only on the yarn withdrawal side (shown by arrow C) of the air passage openings 12.

As shown in FIGS. 6 to 10, it is also contemplated to limit the areas of increased friction value to sections located between the air passage openings 12.

Figure 6:
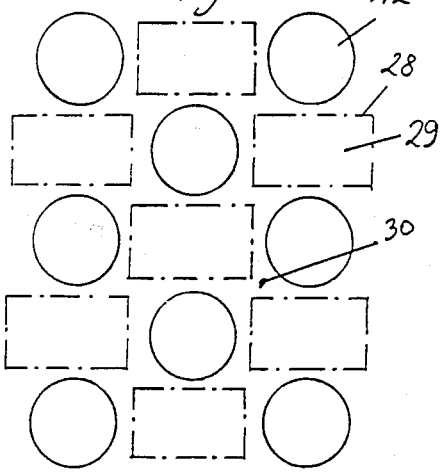
Figure 7:
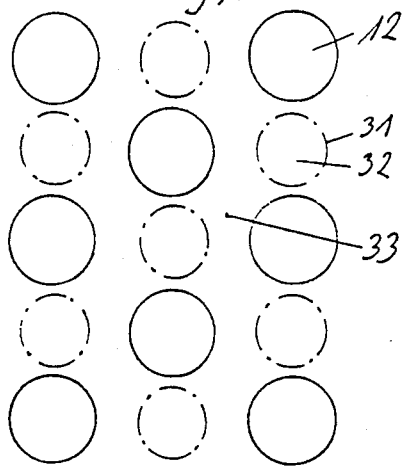
Figure 8:
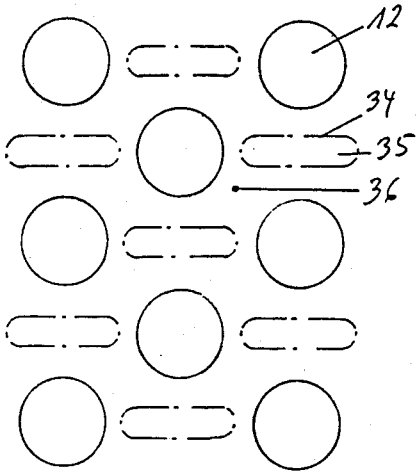
Figure 9:
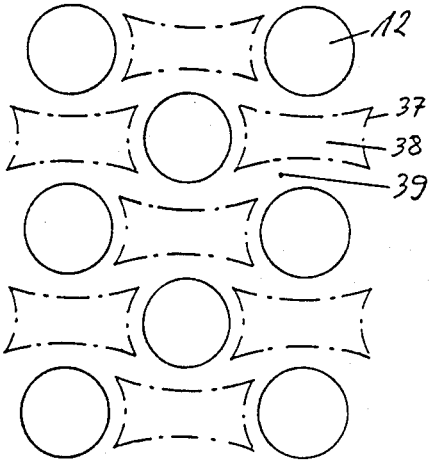

In the embodiment according to FIG. 6, areas 29 with an increased friction value having a rectangular boundary 28 are arranged between the individual air passage openings 12. In the embodiment according to FIG. 7, sections 32 with an increased friction value delimited by a circle 31 are provided between the air passage openings 12. In the embodiment according to FIG. 8, sections 35 with an increased friction value having an essentially oval boundary 34 are provided between the air passage openings 12. It is also contemplated, as shown in FIG. 9, to provide sections 38 with an increased friction value delimited by curved lines 37 between the air passage openings 12. In all of these embodiments, it is contemplated to coordinate the friction effect by the proportioning of the ratio of sizes between sections 29, 32, 35, 38 with an increased friction effect and the areas 30, 33, 36, 39 of the shell surface located in-between.

Figure 10:
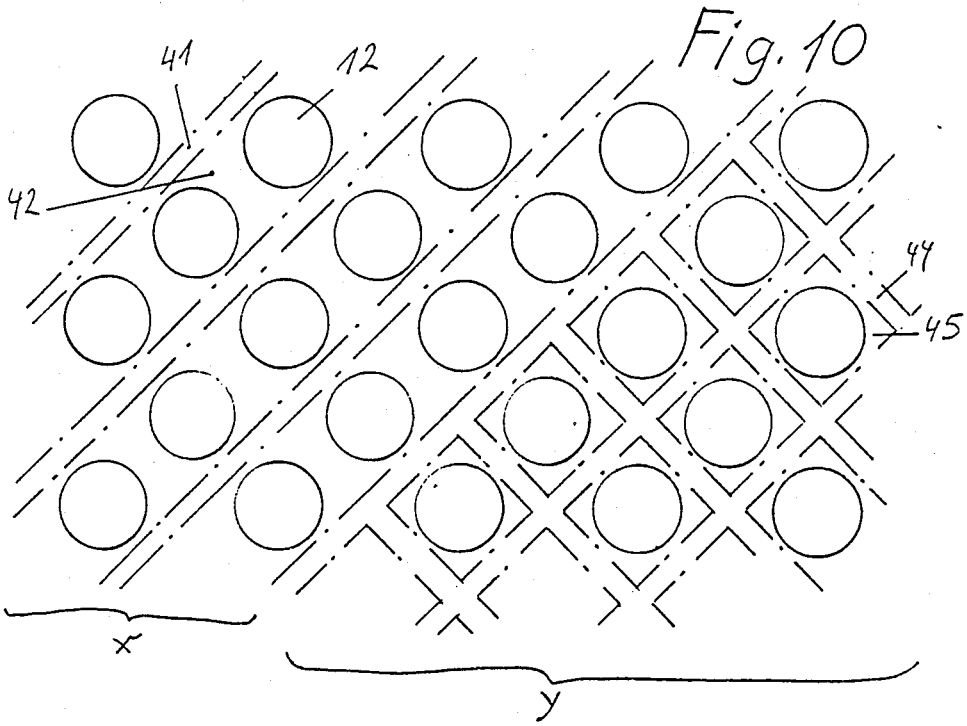
FIG. 10 is a partial view of a roller surface with a friction effect that is graduated into zones or sections in longitudinal direction of the roller.

As shown in FIG. 10, it is also contemplated to provide strip-shaped areas 41, 44 with an increased friction value between the air passage openings 12. In this case, it is also contemplated to divide the whole roller in its longitudinal direction into different areas X, Y with a graduated friction effect, particularly with a friction effect that increases in yarn withdrawal direction. In the embodiment according to FIG. 10, this is achieved by the fact that in the area X with the lower friction area, only parallel strips 41 with an increased friction value are provided that leave between them areas 42 with a lower friction value. In zone Y, areas 41, 44 with an increased friction value are provided that extend at right angles to one another and leave essentially square areas 45 with a lower friction value that surround the air passage openings 12. In addition, it is contemplated to divide the friction values in the areas 42, 45 that surround the air passage openings 12 into zones of differing friction values in yarn withdrawal direction.

It should be observed that the effect of the air passage openings 12 on the tying-in of the individual fibers decreases in yarn withdrawal direction, i.e., the more the fibers are tied into the forming yarn 4, the less is the danger that the yarn structure is disturbed by an excessive retaining of fibers in the area of the air passage openings 12. For this reason, in certain preferred embodiments it may be sufficient if only the mouth areas of the air passage openings 12 of the roller located in the area of the tip of the forming yarn 4, i.e., essentially in the area of the mouth 7 of the fiber feeding duct 5 (FIG. 1), are surrounded with areas of a lower friction value.

Figure 11:
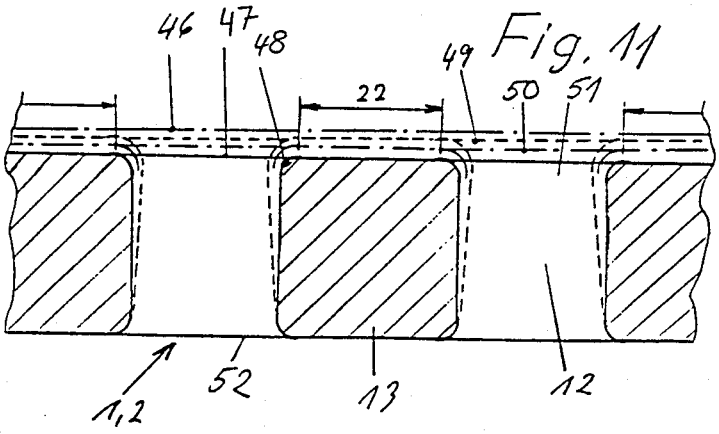
FIG. 11 is a representation of a roller that is similar to FIGS. 2 and 3 during the different stages of its construction.

Using FIG. 11, the individual process steps will be discussed of a preferred process for the manufacturing of a roller 1 or 2 by means of which the friction value distribution according to the invention is obtained. First, a cylindrical roller body is created that has an inner cylindrical surface 52 and an outer cylindrical surface 46. The wall thickness of the roller body measures 3 mm. Staggered air passage openings 12 are then formed. Preferably, the air passage openings 12 are drilled mechanically and have a diameter of between 0.5 mm and 1 mm. The number of staggered air passage openings is selected such that a hole surface of about 30% to 50% of the overall surface is obtained.

Subsequently, the outer shell surface 46 is ground cylindrical to obtain contour 47. The next step is an electro-chemical deburring so that the air passage openings 12 receive slightly rounded mouth edges 48. In the next step, a plasma coating 50 is applied that has a thickness of about 0.1 mm. A plasma spray gun can be used to make the application. A titanium or chromium dioxide coating can be applied as the plasma coating 50. The plasma coating 50 is applied in such a way that the shell first receives an outer contour that is indicated by the line 49. In this case, the plasma coating 50 extends into the air passage openings 12 so that the mouth edges 48 and a part of the interior walls of the air passage openings 12 are also covered by it. By means of this plasma layer 50, a hard surface is created that results in a relatively low friction value with respect to fibers.

In the next step, the roller body is equipped with bearings (not shown) which will later hold the roller body on the pipes 8, 9 (FIG. 1), during the installation onto an open-end friction spinning unit. Roller bearings are used that are pressed into the cylindrical inner surface 52 of the roller body. The plasma coating is subsequently ground off by about 0.04 mm, in which case, the roller body is held by its operational bearings during the cylindrical grinding. By means of this cylindrical grinding, with a support at the operational bearings, a good concentricity of the finished rollers 1, 2 is obtained. The ground-off and polished surface of the coating 50 is retained in this form in the area of the mouth edges 48 of the mouths 51 of the air passage openings 12. In the area 22 between the areas of the mouth edges 48, the outer shell surface will then be structured (roughened), in which case the roller body is also held on its operational bearings. In certain preferred embodiments, the structuring takes place by laser radiation, whereby miniature craters are generated in the area 22 that provide an increased roughness, and thus provide an increased friction value to this area 22.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. Friction surface construction for open-end friction spinning of the type having a movable friction spinning member with yarn forming surface portions that impart friction to fibers and to forming yarn, said yarn forming surface portions comprising:

first surface areas surrounding air passage openings in said friction spinning member;

second surface areas in-between said first surface areas, at least a portion of said first surface areas including a section having a coefficient of friction of friction value different than a coefficient of friction value of said second surface areas.

2. Friction surface construction as in claim 1, wherein said coefficient of friction value of said sections of said at least a portion of said first surface areas is lower than said coefficient of friction value of said second surface areas.

3. Friction surface construction as in claim 2, wherein said friction spinning member is a friction roller having an outer shell yarn forming surface, said air passage openings extending through said outer shell surface.

4. Friction roller construction as in claim 3, wherein said lower friction value sections of said at least a portion of said first surface areas completely surround the corresponding air passage openings.

5. Friction roller construction as in claim 3, wherein said lower friction value sections of said at least a portion of said first surface areas only partially surround the corresponding air passage openings.

6. Friction surface construction as in claim 3, wherein said first surface areas include individual predetermined shaped sections having the lower coefficient of friction value.

7. Friction surface construction as in claim 3, wherein said second surface areas include individual predetermined shaped sections having the higher coefficient of friction value.

8. Friction surface construction as in claim 3, wherein said first surface areas and said second surface areas are the same material, said sections of lower coefficient of friction value having a smoother surface than said areas of higher coefficient of friction value.

9. Friction surface construction as in claim 3, wherein said first surface areas having a lower coefficient of friction value include a coating of a first material and said second surface areas having a higher coefficient of friction value include a coating of a second material, said first material coating having a lower coefficient of friction value than said second material coating.

10. Friction surface construction as in claim 3, wherein said first surface areas include a hard material coating forming a smooth surface.

11. Friction surface construction as in claim 10, wherein said first surface areas include outer mouth areas of the air passage openings having rounded-off outer mouth edges, said hard material coating being included on said rounded-off edges.

12. Friction surface construction as in claim 10, wherein said second surface areas include a hard material coating, said second surface areas hard material coating including a roughened surface.

13. Friction surface construction as in claim 12, wherein said outer shell yarn forming surface includes a cylindrical ground shape, said hard material coating being included on said cylindrical ground outer shell yarn forming surface.

14. Friction surface construction as in claim 3, wherein said first surface areas include a metal oxide film coating.

15. Friction surface construction as in claim 14, wherein said second surface areas include a metal oxide film coating.

16. Friction surface construction as in claim 3, wherein said roller includes a yarn withdrawal end, said second surface areas being divided into at least two sections of different friction values.

17. Friction surface construction as in claim 16, wherein the friction value of said at least two sections increases toward said yarn withdrawal end.

18. Friction surface construction as in claim 3, wherein said roller includes a yarn withdrawal end, said lower friction value section of said at least a portion of said first surface areas only surrounding a part of the air passage openings toward the yarn withdrawal end.

19. Friction surface construction as in claim 2, wherein said first surface areas and said second surface areas are the same material, said sections of lower coefficient of friction value having a smoother surface than said areas of higher coefficient of friction value.

20. Friction surface construction as in claim 2, wherein said first surface area having a lower coefficient of friction value include a coating of a first material and said second surface areas having a higher coefficient of friction value include a coating of a second material, said first material coating having a lower coefficient of friction value than said second material coating.

* * * * *